United States Patent [19]

Boyadjieff et al.

[11] Patent Number: 4,529,045

[45] Date of Patent: Jul. 16, 1985

[54] TOP DRIVE DRILLING UNIT WITH ROTATABLE PIPE SUPPORT

[75] Inventors: George I. Boyadjieff, Anaheim; Igor Krasnov, Fountain Valley, both of Calif.

[73] Assignee: Varco International, Inc., Orange, Calif.

[21] Appl. No.: 593,313

[22] Filed: Mar. 26, 1984

[51] Int. Cl.[3] ..... E21B 3/00

[52] U.S. Cl. ..... 173/164; 173/141

[58] Field of Search ..... 173/141, 145, 146, 163, 173/164, 165; 73/862.21–862.26; 175/52, 85, 113

[56] References Cited

U.S. PATENT DOCUMENTS

| | | | |
|---|---|---|---|
| 3,768,579 | 10/1973 | Klein | 173/164 |
| 3,888,318 | 6/1975 | Brown | 173/164 X |
| 4,037,672 | 7/1977 | Hodge | 173/164 X |
| 4,147,215 | 4/1979 | Hodge et al. | 173/164 X |
| 4,449,596 | 5/1984 | Boyadjieff | 175/85 |

*Primary Examiner*—James M. Meister
*Assistant Examiner*—John L. Knoble
*Attorney, Agent, or Firm*—William P. Green

[57] ABSTRACT

A top drive well drilling unit which is connected to the upper end of a drill string to drive it rotatively in drilling a well and is movable upwardly and downwardly with the string along a guide structure, and which is provided with pipe handling mechanism beneath the drilling unit for making and breaking a threaded connection between the drilling unit and the string and including an elevator which can suspend a section of drill pipe or the entire string when disconnected from the drilling unit. The pipe handling mechanism is retained against rotation with the drill string during a drilling operation, but is constructed to allow rotation of the elevator and a suspended string relative to the drilling unit when the string is supported by the elevator without connection to the drilling unit, in order to allow the string to rotate as it is moved vertically by the elevator and thereby avoid damage to the side wall of the well which may occur if a string having stabilizers is pulled upwardly without such rotation. Desirably, a powered torque wrench of the pipe mechanism is also free to rotate with the elevator during such vertical movement of the string, and is provided with control and power supply connections which need not be disconnected during the rotation.

22 Claims, 16 Drawing Figures

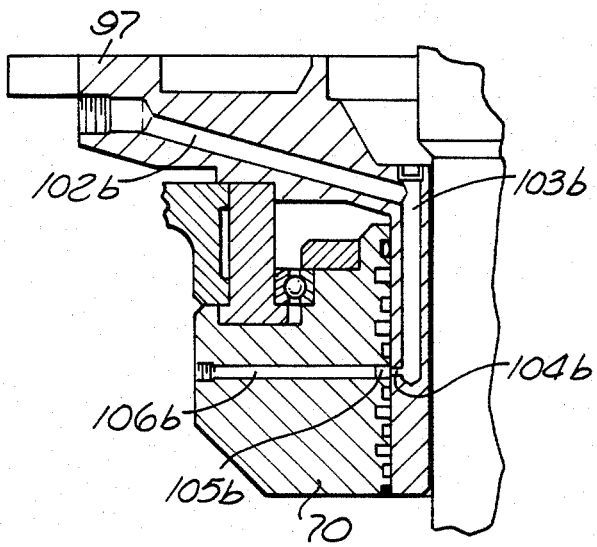
FIG. 9
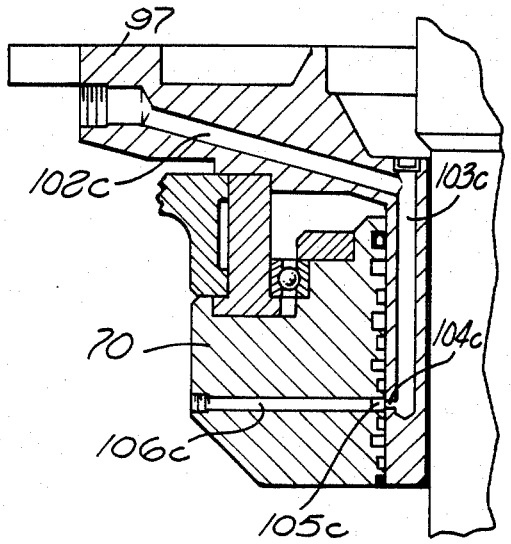
FIG. 10
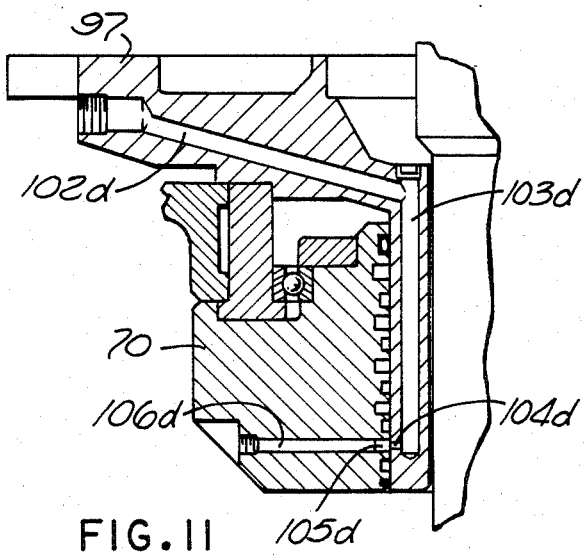
FIG. 11
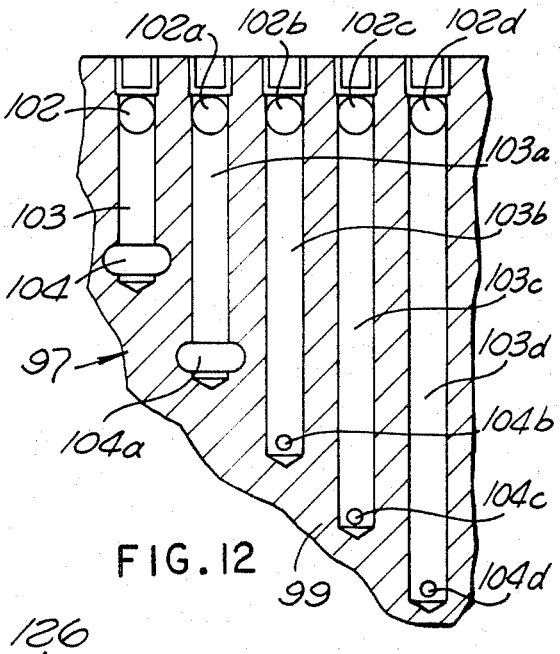
FIG. 12
FIG. 13
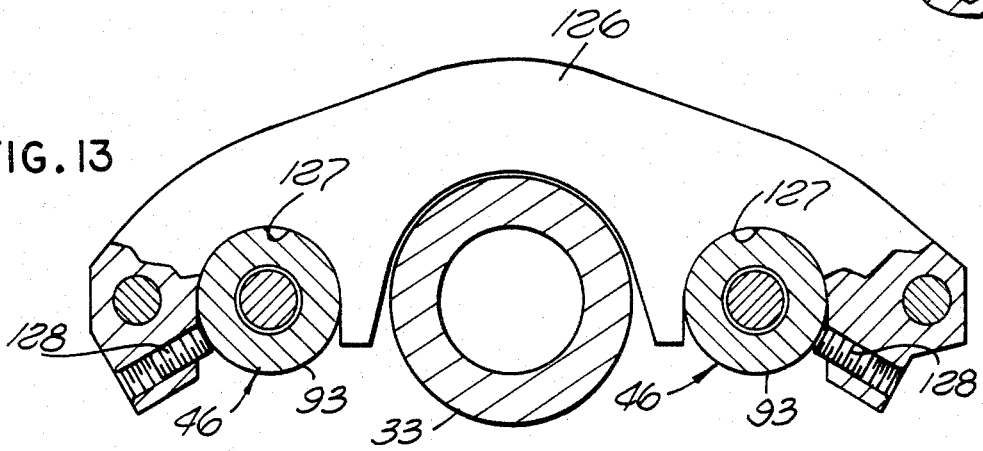

TOP DRIVE DRILLING UNIT WITH ROTATABLE PIPE SUPPORT

BACKGROUND OF THE INVENTION

This invention relates to improvements in top drive well drilling apparatus.

Copending U.S. Pat. No. 4,449,596 filed Aug. 3, 1982 by George I. Boyadjieff on "Drilling of Wells With Top Drive Unit", discloses a well drilling rig including a top drive unit which is connectable to the upper end of a drill string to drive it rotatively and which moves upwardly and downwardly with the string during the drilling operation, and which has associated with it pipe handling mechanism at the underside of the drilling unit for making and breaking joints between the drilling unit and the drill string and for suspending a pipe section or the entire string during handling operations. The drilling unit includes a tubular element which is threadedly connectible to the upper end of the string and through which drilling fluid is delivered downwardly to the string from a swivel at the upper end of the unit, and includes also a motor which drives the tubular element rotatively to turn the string as the well is drilled. The pipe handling mechanism preferably includes a powered torque wrench for making or breaking a threaded connection to the string, and an elevator which is suspended beneath the torque wrench and is adapted to engage an upper section of the drill string and support it when the string is disconnected from the tubular element of the drilling unit. The torque wrench and elevator of the apparatus of that prior application are both retained against rotation with the drill string during the drilling operation.

SUMMARY OF THE INVENTION

The present invention provides improvements in top drive drilling apparatus of the general type described above, and particularly relates to an arrangement in which the pipe handling apparatus is, as discussed, retained against rotation with the drill string during the drilling operation, but is constructed to permit rotation of at least the elevator and preferably the entire pipe handling mechanism about the well axis and relative to the main body or housing of the powered top drive drilling unit when the drill string is detached from the power driven rotary element of the top drive unit and suspended by the elevator of the pipe handling mechanism. Such freedom for rotation of the elevator and drill string relative to the top drive drilling unit is desirable, for example, when the drill string is being moved vertically during removal of the string from the well for bit replacement or other purposes, or during subsequent lowering of the string back into the well. If the string is not permitted to rotate during such vertical movement, the helical stabilizers normally provided on the exterior of the string may cause substantial damage to the side wall of the well as they move vertically while contacting the side wall. That damage is minimized and removal of the string is facilitated when the string is able to rotate as it moves vertically.

Preferably, the entire pipe handling mechanism including the power actuated torque wrench for making and breaking threaded joints, rotates relative to the upper top drive unit during such vertical non-drilling movement of the string. A further feature of the invention relates to the provision of connections for supplying power and control signals to the torque wrench in a manner allowing the connections to remain attached to the pipe handling mechanism even during its rotation, to thus facilitate conversion of the apparatus between the drilling condition in which the pipe handler does not rotate and the round tripping condition in which it does rotate. For this purpose, the apparatus may include swivel connections for conducting actuating hydraulic fluid or other power to and from the torque wrench.

BRIEF DESCRIPTION OF THE DRAWINGS

The above and other features and objects of the invention will be better understood from the following detailed description of the typical embodiment illustrated in the accompanying drawings in which:

FIGS. 7, 8, 9, 10, 11, and 12 are fragmentary vertical sections taken on lines 7—7, 8—8, 9—9, 10—10, 11—11 and 12—12 respectively of FIG. 6; and FIG. 13 is a horizontal section taken on line 13—13 of FIG. 4.

DETAILED DESCRIPTION OF THE PREFERRED EMBODIMENT

Figure 1:
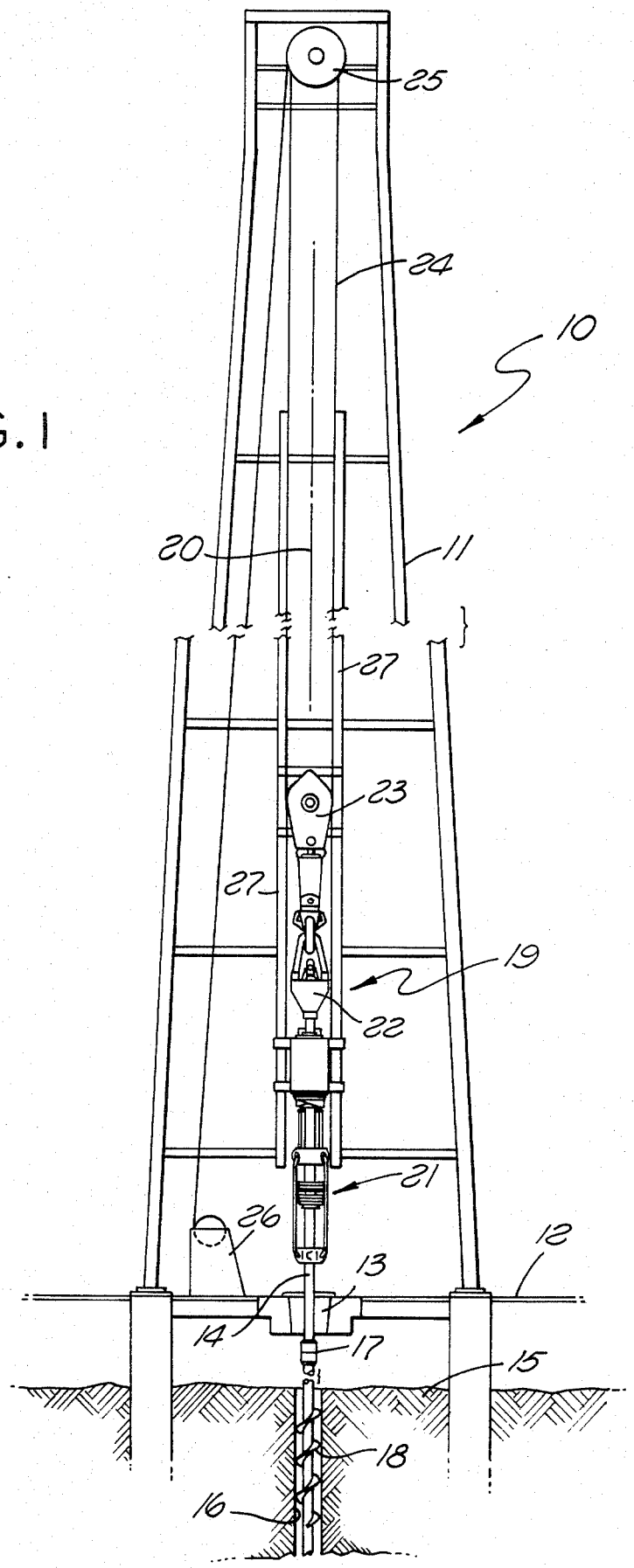
FIG. 1 is a somewhat diagrammatic representation of a well drilling rig having a top drive drilling system embodying the invention.

The top drive drilling rig 10 illustrated in FIG. 1 includes the usual derrick 11 having a rig floor 12 containing an opening 13 through which the drill string 14 extends downwardly into the earth 15 to drill a well 16. The drill string is formed of series of pipe sections interconnected at threaded joints 17 and having a bit at the lower end of the string. At vertically spaced locations, the string has stabilizer portions which may include stabilizer elements 18 extending helically along the outer surface of the string to engage the well bore wall in a manner centering the drill string therein.

The string is turned by a top drive drilling unit 19 which is connected to the upper end of the string and moves upwardly and downwardly therewith along the vertical axis 20 of the well, and which has a pipe handler assembly 21 suspended from the drilling unit. The drilling unit 19 has a swivel 22 at its upper end through which drilling fluid is introduced into the string, and by which the unit is suspended from a traveling block 23 which is suspended and moved upwardly and downwardly by a line 24 connected at its upper end to a crown block 25 and actuated by the usual draw works represented at 26. The drilling unit 19, pipe handler 21 and connected parts are guided for vertical movement along axis 20 by two guide rails or tracks 27 rigidly attached to derrick 11. The drilling unit 19 is attached to a carriage 28 (FIGS. 2 and 3) having rollers 29 engaging and located by rails 27 and guided by those rails for only vertical movement upwardly and downwardly along the rails parallel to axis 20.

Figure 3:
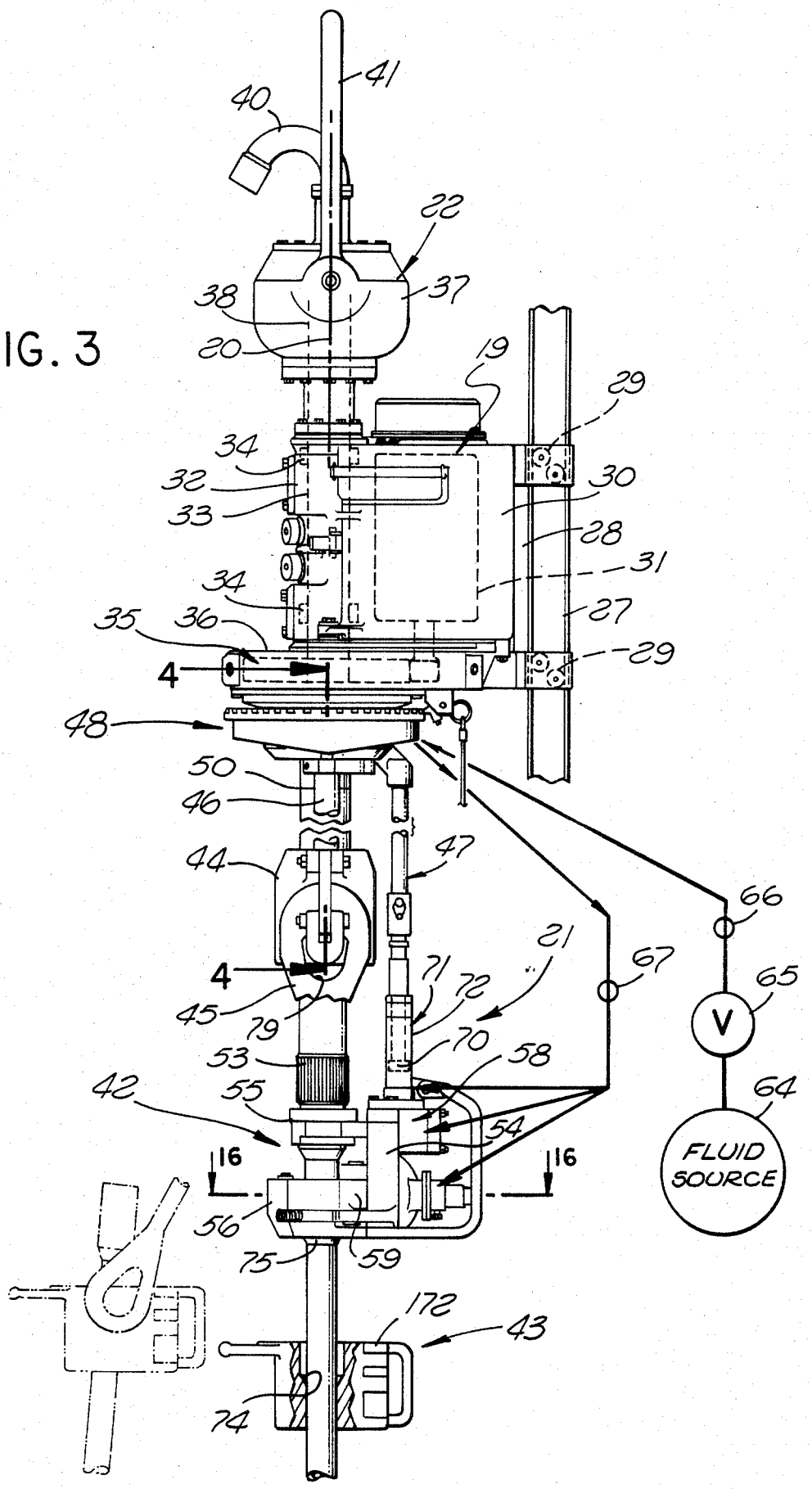
FIG. 3 is a side elevational view taken on line 3—3 of FIG. 2.

The top drive drilling unit 19 includes a housing or body 30 which is connected to carriage 28 in fixed position relative thereto during drilling and round tripping operations, and which contains a motor diagrammatically represented at 31 in FIG. 3. The housing 30 has a tubular vertically extending portion 32 within which a vertical tubular element or pipe section 33 is journaled by bearings 34 for rotation relative to the housing about the vertical axis 20 of the apparatus. The motor drives the tubular stem 33 rotatively about axis 20 through the speed reduction gear assembly 35 contained within a lower portion 36 of housing 30. Swivel 22 is of conventional construction, having an outer body 37 within which a tubular element 38 connected to the upper end of the drilling unit stem 33 is rotatable, with the drilling fluid being fed downwardly through the swivel and tubular element 33 of the drilling unit into the drill string from a goose neck 40. The swivel is suspended from the traveling block by the usual bail 41.

The pipe handler mechanism 21 which is suspended by and moves upwardly and downwardly with drilling unit 19 includes a torque wrench 42, an elevator 43 suspended from a carrier part 44 through links 45, two torque arresters 46 for retaining part 44 against rotation, and a structure 47 for supporting and actuating torque wrench 42. In addition, the apparatus includes an assembly 48 supporting the various elements of the pipe handler from drilling unit 19 in a relation preventing rotation of the pipe handler parts relative to the drilling unit during a drilling operation but permitting such rotation when the drill string is detached from the stem 33 of the drilling unit and is being raised or lowered by elevator 43.

Pipe handler 21 includes a hollow tubular pipe section or sub 49 which is threadedly connected to the lower end of the powered rotary stem 33 of the drilling unit at 50, and which has an externally threaded pin portion 51 at its lower end connectable to the upper internally threaded end 52 of the upper section 14' of drill string 14, to enable the drilling unit to rotatively drive the drill string through the elements 33 and 49. At a location near its lower end, element 49 may have an externally splined portion 53 for coaction with the torque wrench.

Figure 2:
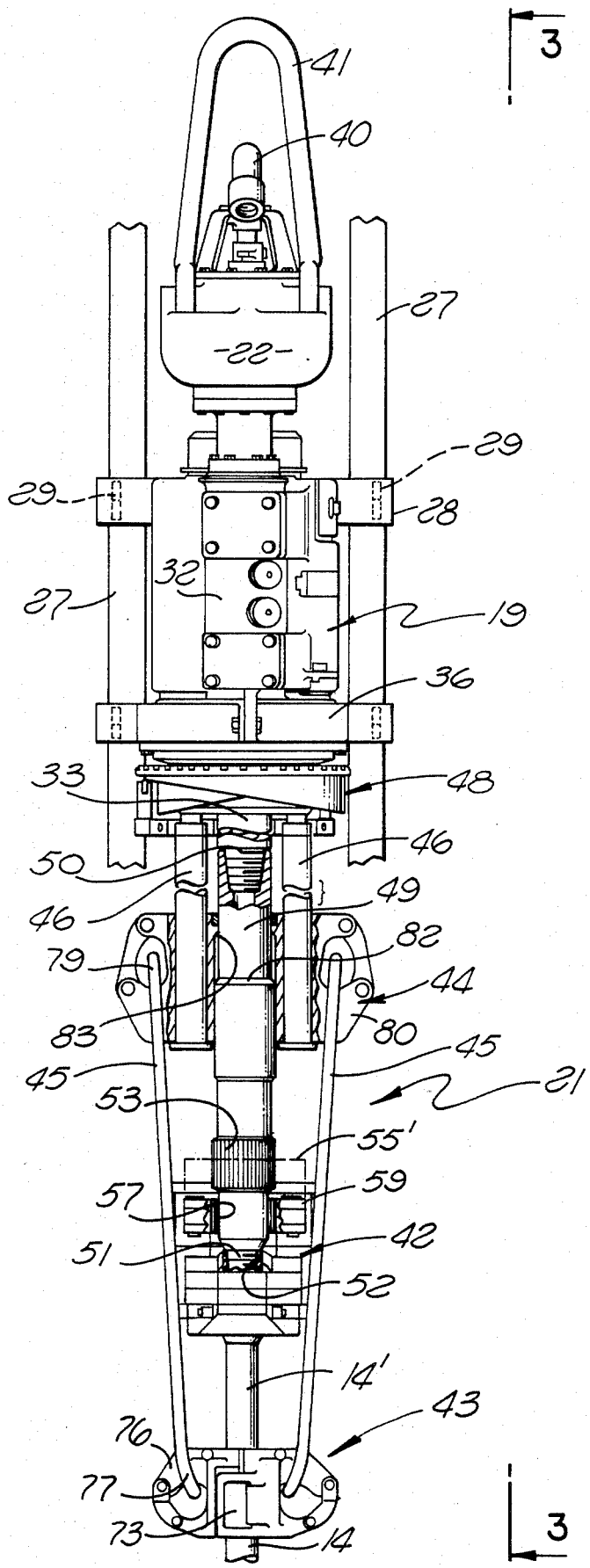
FIG. 2 is an enlarged front elevational view of the top drive unit and pipe handling mechanism of FIG. 1.

The torque wrench includes a rigid body structure 54 which is suspended from the upper drilling unit 19 by the previously mentioned structure 47, and which includes an upper section 55 of the torque wrench and a lower section 56. Section 55 contains internal splines 57 which in the position of FIGS. 2 and 3 are located beneath and out of engagement with the splined portion 53 of element 49, but which are movable upwardly into engagement with splines 53 in an upper position of the upper section of the torque wrench represented in broken lines at 55' in FIG. 3. In that upper position, the parts 49 and 55 are keyed together by the splines so that the part 55 can apply torque about axis 20 to element 49. This torque is developed by two piston and cylinder mechanisms 58 (FIG. 3) having their cylinders rigidly connected to body 54 of the torque wrench and having their pistons connected to ears 59 of element 55 to rotate the element about axis 20.

Figure 16:
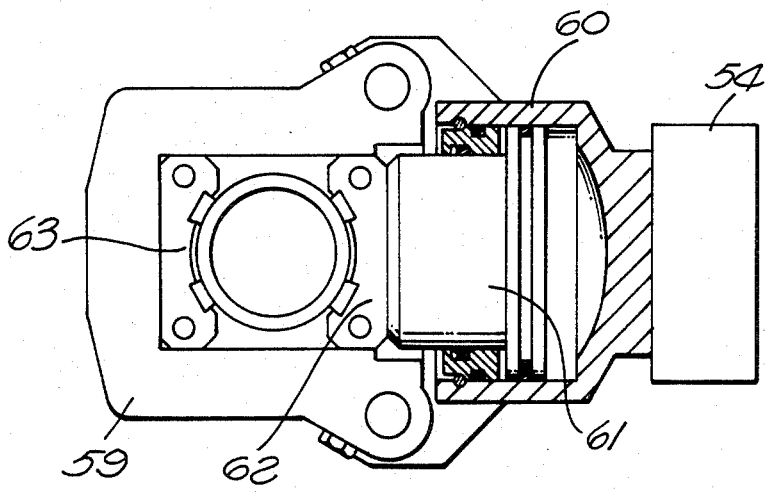
FIG. 16 is an enlarged horizontal section taken on line 16—16 of FIG. 3.

Lower section 56 of the torque wrench includes a body 59 disposed about an upper joint end of the top section of drill string 14 and rigidly connected to body structure 54 of the torque wrench. A cylinder 60 (FIG. 16) carried by body structure 54 of the torque wrench contains a piston 61 which is actuable by fluid pressure to force a gripping jaw structure 62 within body 59 of section 56 toward and away from a second gripping jaw structure 63 to tightly grip the upper section of the drill string and retain it against rotation while element 49 is turned in either direction by upper section 55 of the torque wrench to make or break the threaded connection between element 49 and section 14' of the drill string. Hydraulic fluid under pressure is supplied to and discharged from cylinder 60 and the two cylinders 58 of upper section 55 from a source 64 of pressure fluid under the control of a manually actuable control valve unit 65, through a number of hydraulic lines 66 which extend to the rotary swivel assembly 48 at the upper end of the pipe handler, and then through a number of lines 67 leading from the assembly 48 to cylinders 58 and 60. The assembly 48 enables maintenance of continuous communication between each of the lines 66 and a corresponding line 67 as the pipe handler rotates relative to the top drive drilling unit.

The structure 47 for suspending the torque wrench includes a part 68 (FIG. 5) which is connected by a horizontal pivot pin 69 to a part 70 of assembly 48, and which rigidly carries a vertical rod 169 attached to the piston 70 of a piston and cylinder mechanism 71, whose cylinder 72 is rigidly connected to body 64 of the torque wrench. The piston and cylinder mechanism 71 is actuable by hydraulic pressure fluid supplied to it through one of the lines 67 to raise and lower the torque wrench between its full line and broken line positions of FIG. 2 under the control of manually actuated control unit 65.

Elevator 43 may be of any conventional construction, including two body sections which are pivoted together at 172 for opening and closing movement to enable the elevator to be placed about a section of the drill pipe and removed therefrom as desired. An appropriate latching mechanism represented at 73 is adapted to releasably hold the two sections in their closed position. When closed, the elevator is capable of supporting the entire weight of the drill string, and for that purpose may have an internal annular upwardly facing shoulder 74 engageable with a joint end enlargement 75 at the upper end of the drill string structure to prevent downward movement of the drill string relative to the elevator. Alternatively, the elevator may be of a type containing slips for gripping and supporting the upper drill pipe section. At its opposite sides, the elevator has loops 76 engaged by the lower loop portions 77 of links 45, whose upper loops 79 engage loops 80 of carrier part 44 to suspend the elevator and drill string therefrom in the FIG. 15 condition of the apparatus.

The carrier part 44 has a passage 81 extending vertically therethrough and fitting closely about the externally cylindrical element 49 to allow rotation of that element and the drill string relative to the carrier part during a drilling operation. The external diameter of element 49 may be reduced above the location of an annular shoulder 82 which faces upwardly within the interior of carrier part 44 and is engageable with a downwardly facing annular shoulder 83 formed in the carrier part to support the carrier part and links 45 and elevator 43 and the drill string from the rotary element 49 in the FIG. 15 condition. During drilling, however, the carrier part is elevated above the FIG. 15 position and maintained yieldingly in the FIG. 2 position by springs 84 contained within torque arrestors 46, to maintain shoulder 83 at a location spaced above and out of engagement with shoulder 82 in a manner freeing element 49 and the drill pipe for rotation relative to carrier part 44.

Figure 4:
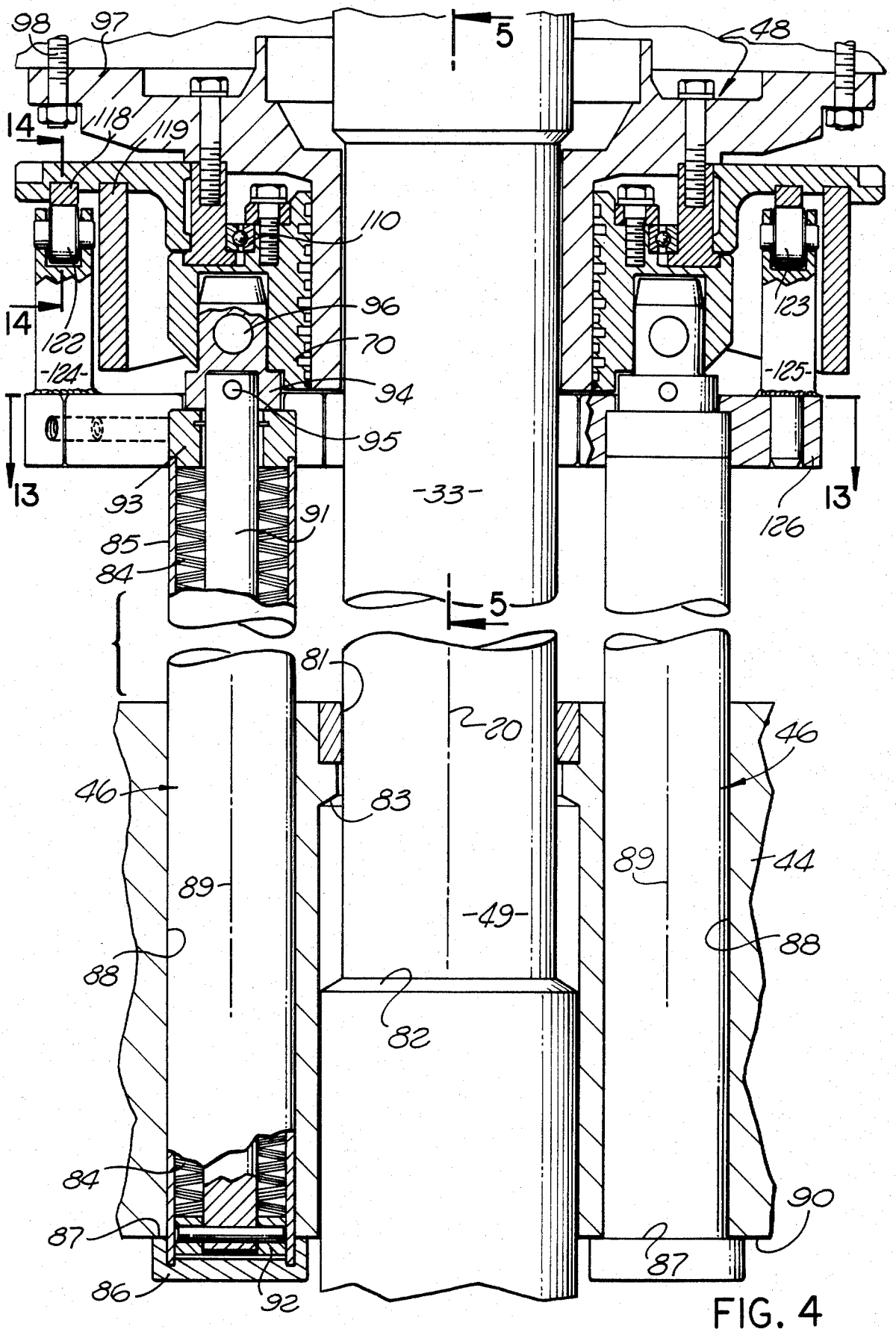
FIG. 4 is a further enlarged fragmentary vertical section taken on line 4—4 of FIG. 3.

As seen in FIG. 4, each of the torque arrestors 46 includes an outer cylindrical body 85 which may be closed at its lower end by a bottom wall 86 rigidly secured to the cylindrical body and forming an upwardly facing annular shoulder 87. The bodies 85 of the two torque arresters extend vertically through two cylindrical vertical passages 88 in carrier part 44 and along two vertical axes 89 which are parallel to the main vertical axis 20 of the apparatus and offset at diametrically opposite sides of that main axis. Shoulder 87 at the lower end of each of the torque arrestors is engageable upwardly against a bottom surface 90 of carrier part 44, to support the carrier part through the torque arrestors in the FIGS. 2 and 3 condition of the apparatus.

Each of the torque arrestors also includes, within its outer body 85, a central vertical rod 91 having an enlarged head 92 at its lower end engageable upwardly against the bottom of the spring structure 84, while the upper end of that spring structure bears upwardly against a top annular wall 93 rigidly connected to the cylinder body 85, to thereby yieldingly urge rod 91 downwardly to its FIG. 4 position relative to the surrounding body 85. The springs 84 may be a stack of belleville washer type elements as illustrated. At its upper end, each rod 91 is connected rigidly to a connector element 94 by a pin 95, with the element 94 projecting upwardly into a socket recess in the previously mentioned part 70, and being attached rigidly thereto by a horizontal pin 96.

Figure 5:
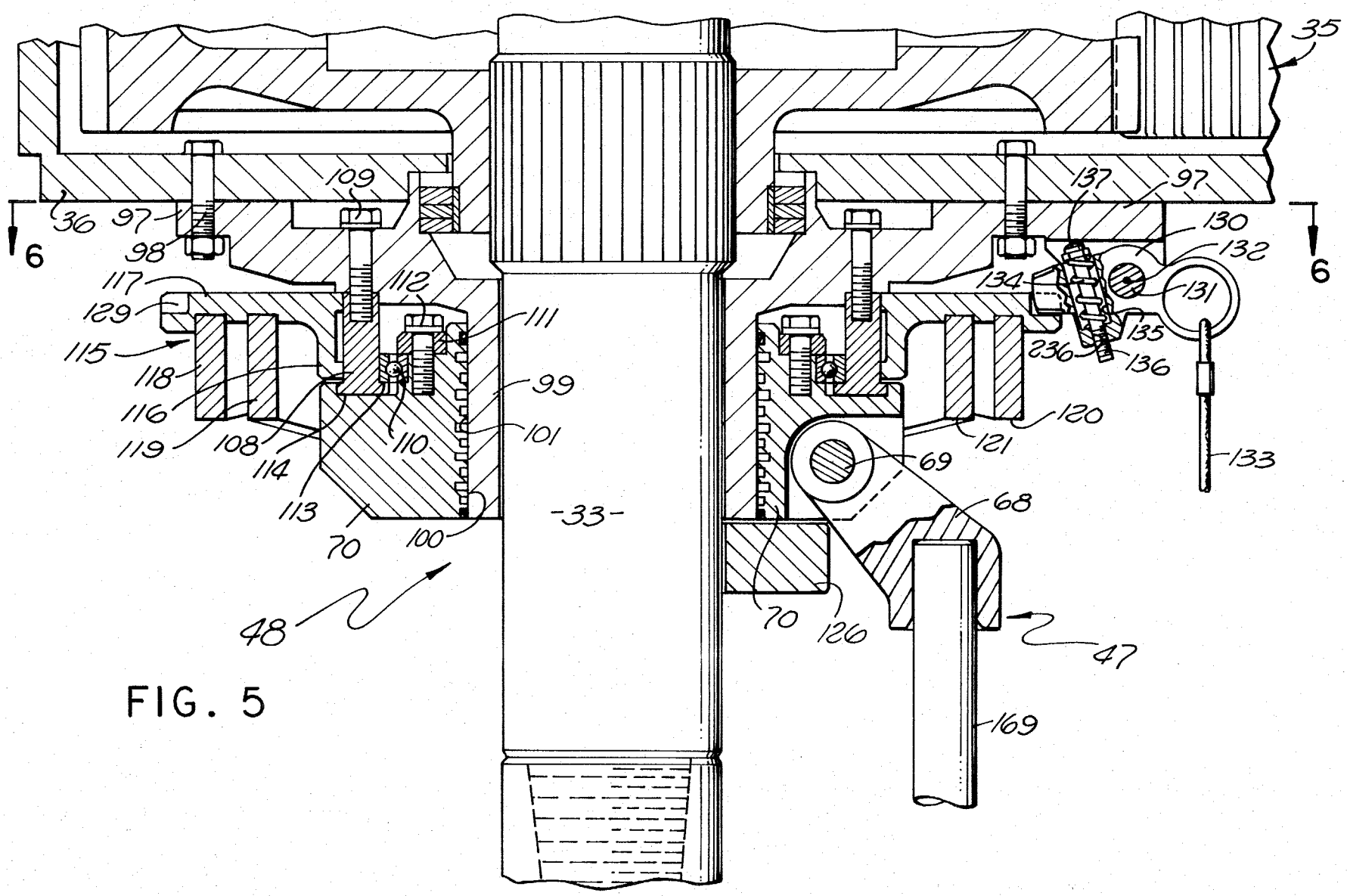
FIG. 5 is a vertical section taken on line 5—5 FIG. 4.
Figure 6:
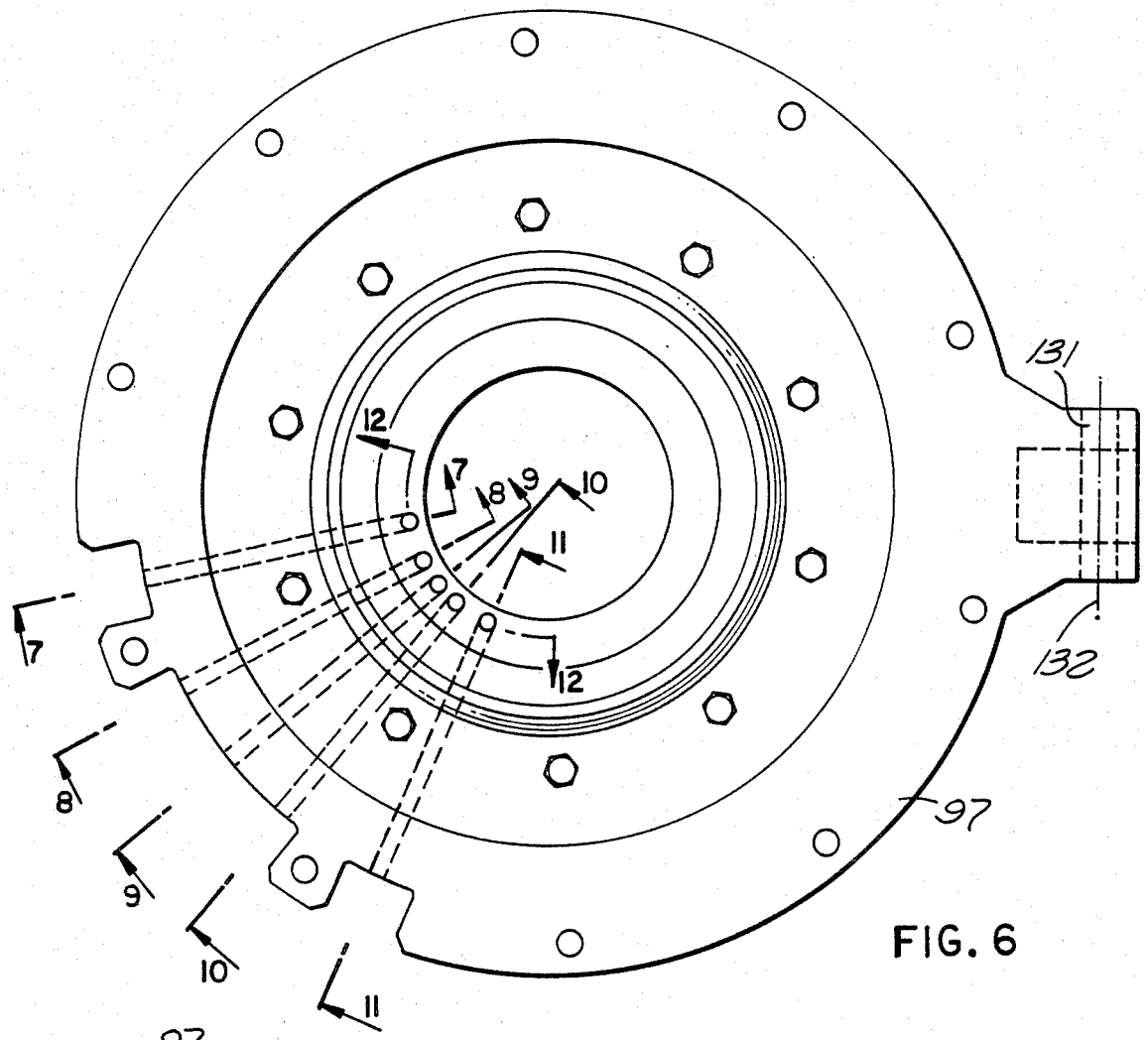
FIG. 6 is a reduced horizontal section taken on line 6—6 of FIG. 5.
Figure 7:
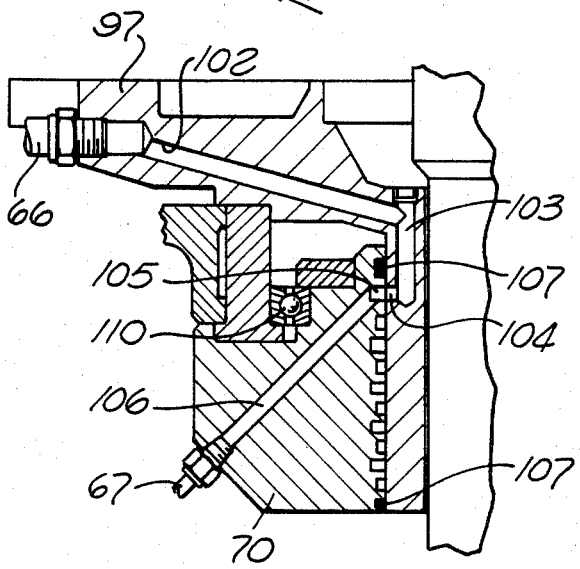
Figure 8:
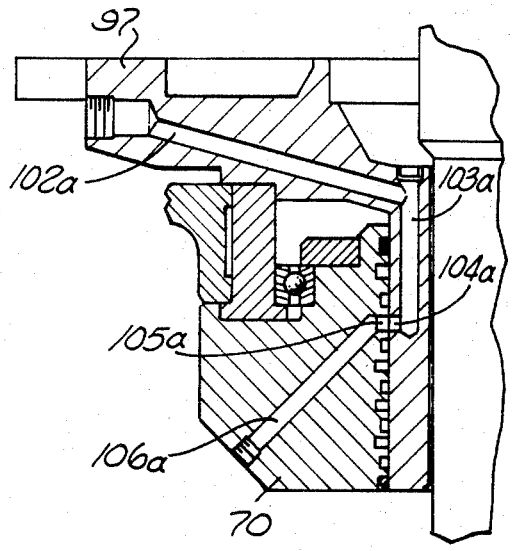

As seen in FIGS. 4 and 5, the assembly 48 at the upper end of the pipe handler includes an upper mounting part 97 which is secured to the underside of the bottom section 36 of the non-rotating housing 30 of the top drive drilling unit 19 by a number of circularly spaced screws 98. This part 97 extends annularly about the powered driven rotary element 33 of the drilling unit, and may have a lower downwardly projecting tubular portion 99 which is a close fit about element 33 but may be spaced slightly therefrom to avoid interference with the rotation of element 33. Part 70 is essentially annular and disposed about portion 99 of the mounting part 97, and is rotatable relative thereto, with an inner cylindrical surface 100 of part 70 rotatably engaging an external surface 101 of portion 99 of the mounting part 97. The two parts 97 and 70 contain passages which communicate with one another at the surfaces 100 and 101, and which are sealed with respect to one another to conduct fluid between these relatively rotatable parts in all relative rotary positions thereof, and thus provide the desired swivel type connection between each of the conduits 66 and a corresponding one of the conduits 67. For example, as seen in FIG. 7, a first of the lines 66 may be connected into a passage 102 in part 97, which extends radially inwardly to the upper end of a passage 103 in that part, which communicates at its lower end with a radially outwardly extending passage 104 communicating with an annular recess or passage 105 formed in part 70, which in turn communicates through a passage 106 in part 70 with one of the lines 67 leading to one of the cylinders 58 or cylinder 60 or piston and cylinder 71. Similarly, as seen in FIG. 8 a second of the lines 66 is placed in communication with a corresponding one of the lines 67 through passages 102*a*, 103*a*, 104*a*, 105*a* and 106*a* corresponding to passages 102, 103, 104, 105 and 106 of FIG. 7. The communication between others of the lines 66 and 67 are represented in FIGS. 9, 10 and 11, in which the various passages corresponding to 102, 103, 104, 105 and 106 are identified by the numbers 102*b*, 103*b*, 104*b*, 105*b* and 106*b*, 102*c*, 103*c*, 104*c*, 105*c* and 106*c* and 102*d*, 103*d*, 104*d*, 105*d* and 106*d*. Above and below each of the pairs of communicating passages, part 70 contains additional annular grooves within which seal rings 107 are located for annularly engaging the two elements 97 and 70 to form annular fluid tight seals therebetween.

Part 70 is further located for rotation relative to part 97 by provision of an annular element 108, which is secured to part 97 by a series of circularly spaced screws 109, and which projects downwardly from part 97 and retains a bearing 110 having its outer race confined within part 108 and having its inner race clamped to part 70 by a ring 111 retained by screws 112. The outer race of bearing 110 may be supported on an annular flange 113 of element 108, with part 70 being restrained against upward movement by annular engagement with element 108 at 114.

Figure 14:
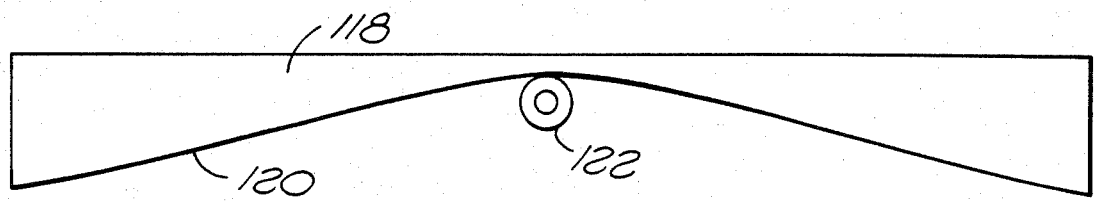
FIG. 14 is a developed diagrammatic representation of one of the camming ramps taken on line 14—14 of FIG. 4.

Disposed rotatably about element 108, there is provided a member 115, having an annular vertically extending portion 116 engaging the outer annular surface of part 108 for location relative thereto, and having a radially projecting horizontal portion 117 to which two downwardly projecting cam elements 118 and 119 are rigidly secured. Each of these elements 118 and 119 is essentially annular about the main vertical axis 20 of the apparatus except that the undersurfaces of elements 118 and 119 are cut off as illustrated (see FIG. 14) to form camming ramp surfaces 120 and 121 engageable with cam rollers 122 and 123 carried by vertical posts 124 and 125 respectively. These posts are in turn secured rigidly to a horizontally extending element 126 having the horizontal sectional configuration illustrated in FIG. 13 to define recesses 127 within which the upper ends of the cylindrical bodies 85 (and their top walls 93) of the torque arresters are rigidly received. As seen in FIG. 13, two set screws 128 are tightenable against the top walls 93 of the cylindrical bodies of the torque arrestors to connect element 126 rigidly thereto. Camming ramp surface 120 of cam element 118 has its highest point at the location represented in the left portion of FIG. 4, and has its lowest point in the right hand portion of the figure. Between these two locations, the ramp surface 120 is inclined at a camming angle as illustrated in FIG. 14, so that the exertion of upward force by roller 122 against ramp surface 120 tends to rotate element 126 about axis 20 relative to part 117 and to the position of FIG. 4 in which the roller engages the highest point of the ramp surface. As will be apparent from FIG. 14, this inclination of the ramp surface between its lowest portion and highest portion is the same in extending in either circular direction between those two regions. The ramp surface 121 at the bottom of the second cam element 119 is the same as the discussed ramp surface 120 of element 118, except that element 119 is turned through 180° relative to element 118 so that the lowermost portion of ramp surface 121 is shown to the left in FIG. 4 and the highest portion is shown to the right in that figure. The roller 123 which engages ramp surface 121 is similarly connected to member 126 at a location offset 180° from roller 122 and its post 124, so that the effect of roller 123 supplements the effect of roller 122, and both tend to return part 126 and part 70 and the pipe handler elements supported thereby to the rotary position illustrated in FIG. 4. As will be understood, the springs 84 within the torque arresters supply the yielding force which urges part 126 and rollers 122 and 123 upwardly to attain the discussed camming action.

Element 117 is adapted to be retained in a set rotary position relative to mounting part 97 and the top drive drilling unit 19, but with that setting being adjustable to allow an operator to predetermine and vary the direction in which the openable side of elevator 72 faces during a pipe handling operation. To enable retention of part 117 in a desired rotary setting, that part contains a series of circularly spaced notches 129 which are engageable by a latching element 130 connected to part 97 by a pin 131 for relative pivotal movement about a horizontal axis 132. An actuating chain or cord 133 may be connected to an outer portion of latch part 130 in a relation enabling an operator to pull the right hand portion of the latch element downwardly as seen in FIG. 5 and thereby raise the left hand portion of that element upwardly out of one of the notches 129 to permit rotation of part 117 relative to part 97. A spring 134 contained within an upwardly opening recess 135 in latch element 130 is disposed about the shank of an element 136 and bears upwardly against its head 137 to yieldingly urge element 136 upwardly against an undersurface of part 97 in a manner urging the left portion of the latch as viewed in FIG. 5 downwardly into one of the notches 129 to releasably retain part 117 in a set position. As will be understood, the notches are provided at closely spaced locations about the entire annular periphery of part 117 to enable that part to be set in virtually any desired rotary position. The shank of element 136 may be threaded for engagement with a nut during assembly of the apparatus, but extends through an unthreaded passage 236 in part 130 to allow upward and downward spring induced movement of element 136 relative to part 130.

In utilizing the apparatus for drilling a well, the equipment is in the condition illustrated in FIGS. 2 and 3, in which motor 31 acts to drive element 33 and the connected part 49 of the pipe handler, as well as drill string 14 connected to the lower end of part 49, to thereby rotate the bit and progressively drill the well. Elevator 43 may in this condition be open to avoid interference with downward advancement of the drill string. When the drilling has progressed to a point at which an additional stand of drill pipe must be connected to the upper end of the string, the torque wrench 42 is actuated to disconnect the top drive unit from the upper end of the drill string. This result is attained by first actuating the control valve assembly 65 at the rig floor to supply pressure fluid from source 64 to piston and cylinder mechanism 71 in a manner raising the torque wrench to its broken line position of FIG. 2, in which the splines of its upper section 55 engage splines 53 of element 49 to prevent relative rotation therebetween. Control valve 65 is then actuated to supply pressure fluid to cylinder 60 of the lower section 56 of the torque wrench in a manner causing that section to tightly grip the upper end of the top section of the drill string and retain it against rotation as the cylinders 58 of the top section are supplied with pressure fluid under the control of unit 65 in a manner causing both cylinders to turn the upper section and the connected element 49 rotatably about axis 20 relative to the upper end of the drill string to thereby break the threaded connection between section 49 and the drill string. After this connection has been broken, the control unit can be actuated to again lower the torque wrench to its full line position of FIG. 2, after which the motor 31 of the top drive drilling unit may be energized to spin element 49 threadedly out of the top section 14' of the drill string. The entire apparatus can then be moved upwardly by the hoisting equipment suspended by crown block 25, to move the elevator upwardly above the upper end of the drill string, after which the elevator may be swung laterally to the broken line position of FIG. 3 in which the elevator can engage a section of pipe contained within an adjacent mousehole. The elevator is closed about this section of pipe, and the drilling unit is then hoisted upwardly in the derrick by upward movement of the traveling block to lift the additional section or stand of pipe out of the mousehole and then lower it downwardly into a position in which it can engage and be screwed into the upper end of the top section of the drill string. The motor of the top drive unit may be utilized for making the connection between the upper end of the added section of pipe and element 49, and between the lower end of that section of pipe and upper end of the drill string, after which the drill string can be rotated by the motor and progressively advanced downwardly to drill further into the earth, until the drilling unit and string reach a point at which another pipe section must be added to the string.

During the drilling operation and during the addition of a pipe section to the string as discussed above, the springs within torque arresters 46 maintain carrier part 44 and the connected parts, as well as part 126 and rollers 122 and 123 of FIG. 4 in their uppermost positions. Thus, the springs act to cam the torque arresters and elevator and other portions of the pipe handler mechanism to a certain predetermined rotary setting relative to the top drive drilling unit 19. This setting is such as to cause the open side of the elevator to face in a predetermined direction for optimum handling of the pipe by an operator. Also, this setting can be adjusted by releasing the latch element 130 and rotating the part 115 to a changed setting, in correspondence with changes in the position in which pipe may be racked on the rig as the pipe handling operations progress.

Figure 15:
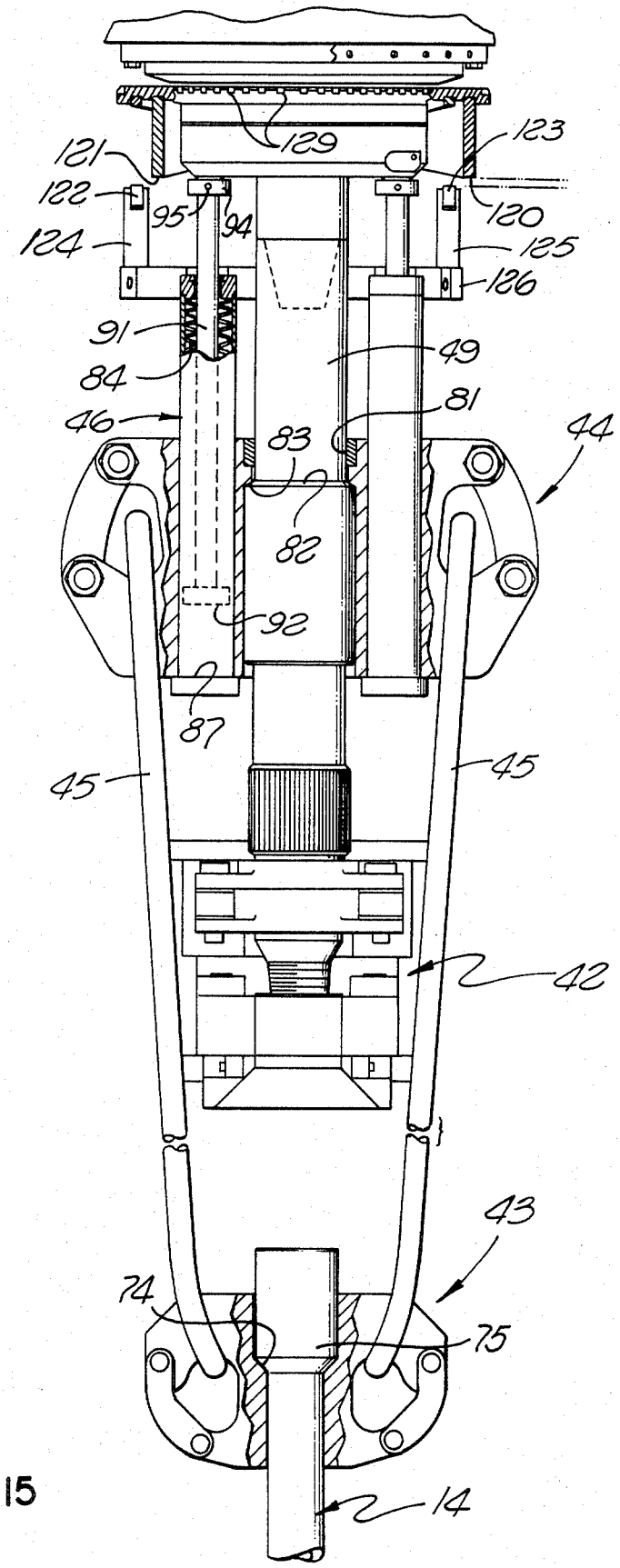
FIG. 15 is a view similar to a portion of FIG. 2, but showing the pipe handler as it appears during removal of the drill string from the well.

When it is desired to remove the drill string or a portion of it from the hole, element 49 is disconnected from the upper end of the string by use of the torque wrench in the manner discussed above, and the entire string is then suspended by elevator 43 as illustrated in FIG. 15. In that condition, the weight of the drill string is great enough to cause the elevator and links 45 as well as carrier part 44 to move downwardly relative to the inner rods 91 of the torque arresters, and to the positions illustrated in FIG. 15, in which rollers 122 and 123 are both located entirely beneath the level of the lowermost portions of camming ramp surfaces 120 and 121, so that the part 126 and rollers 122 and 123 can turn through 360° without any contact between the rollers and the ramp surfaces. With the apparatus in this condition, the hoisting mechanism is actuated to pull the traveling block and top drive unit upwardly, in a manner raising an upper section or stand of the drill string entirely above the level of the rig floor, for disconnection from the remainder of the string and racking at a side of the well. This operation is repeated as many times as necessary to remove the entire string from the well. As each stand or section of the string is pulled upwardly, the pipe handling mechanism and string are free to rotate about the vertical axis of the well, and the helical stabilizers tend to induce such rotation by virtue of their engagement with the bore wall. When permitted to rotate in this manner, the stabilizers are able to thread or screw their way upwardly from the well without damaging the bore wall. The same type of rotation is permitted as the string is subsequently lowered back into the hole, to again prevent damage to the well bore as a result of vertical movement of the stabilizers within the well.

The swivel type fluid passage arrangement illustrated in FIGS. 7 through 12 enables the pipe handling mechanism to rotate in the manner discussed without the necessity for breaking the fluid connections between the valve control unit 65 and the fluid actuated portions of the pipe handler mechanism.

While a certain specific embodiment of the present invention has been disclosed as typical, the invention is of course not limited to this particular form, but rather is applicable broadly to all such variations as fall within the scope of the appended claims.

We claim:

1. Well drilling apparatus comprising:

a top drive unit to be received at the upper end of a drill string and which is movable upwardly and downwardly with the string and includes a tubular member to be connected to the upper end of the string for rotation therewith about the axis of the string and a motor for power rotating said member and the connected string to drill a well;

a pipe handler including a powered torque wrench operable to apply torque in opposite directions to said string and said tubular member and an elevator adapted to suspend said string when it is detached from said member; and connecting means attaching said pipe handler to said top drive unit for movement upwardly and downwardly therewith, and actuable between a first condition in which the elevator and a suspended string are free to rotate relative to said top drive unit about said axis during vertical movement of the string and a second condition in which said connecting means retain said elevator and torque wrench against rotation about said axis with said tubular member and string as they turn to drill a well;

said connecting means including two relatively rotatable elements which deliver power to said pipe handler to control its operation and which have coacting portions received adjacent one another constructed to transmit power directly therebetween in different relative rotary settings of said elements, in a relation allowing free rotation of the elevator and a suspended string relative to the top drive unit through an unlimited number of revolutions without interrupting the capability for transmission of control power to the pipe handler through said elements.

2. Well drilling apparatus as recited in claim 1, in which said coacting portions of said two elements contain fluid passages which face one another in communicating relation and are constructed to maintain such communication during relative rotation of the passages through an unlimited number of revolutions of said elements relative to one another.

3. Well drilling apparatus as recited in claim 1, in which said top drive unit has a non-rotating housing to which a first of said elements is attached in fixed relation, the second of said elements being connected to said torque wrench and elevator for rotation therewith relative to said housing of the top drive unit in said first condition of said connecting means.

4. Well drilling apparatus as recited in claim 1, in which said connecting means include means for automatically turning said pipe handler to essentially a predetermined rotary setting relative to said top drive unit upon actuation of said connecting means to said second condition thereof in which the elevator and torque wrench are retained against rotation.

5. Well drilling apparatus as recited in claim 1, in which said connecting means include means for automatically turning said pipe handler to essentially a predetermined rotary setting relative to said top drive unit upon actuation of said connecting means to said second condition thereof in which the elevator and torque wrench are retained against rotation, said means for automatically turning the pipe handler being rotatively adjustable to vary the rotary setting to which said means automatically turn the pipe handler upon actuation of said connecting means to said second condition thereof.

6. Well drilling apparatus as recited in claim 1, in which said connecting means include means supporting said elevator yieldingly for movement downwardly relative to said top drive unit by the weight of a drill string suspended by the elevator, said connecting means including means responsive to upward movement of the elevator relative to said top drive unit to turn the pipe handler toward essentially a predetermined rotary setting relative to the top drive unit upon upward movement of the elevator relative to the top drive unit.

7. Well drilling apparatus as recited in claim 1, in which said connecting means include means yieldingly supporting said elevator for downward movement relative to said top drive unit by the weight of a drill string supported by the elevator, there being first cam means movable upwardly and downwardly with said elevator, and second cam means engageable by said first cam means upon upward movement of the elevator relative to the top drive unit to turn the pipe handler to essentially a predetermined rotary setting relative to the top drive unit.

8. Well drilling apparatus as recited in claim 7, including means mounting said second cam means for rotary adjusting movement relative to said top drive unit to vary the position to which said first and second cam means turn the elevator upon upward movement of the elevator relative to the top drive unit.

9. Well drilling apparatus comprising:

a top drive unit to be received at the upper end of a drill string and which is movable upwardly and downwardly with the string and includes a tubular member to be connected to the upper end of the string for rotation therewith about the axis of the string and a motor for power rotating said member and the connected string to drill a well;

a pipe handler including a powered torque wrench operable to apply torque in opposite directions to said string and said tubular member and an elevator adapted to suspend said string when it is detached from said member; and connecting means attaching said pipe handler to said top drive unit for movement upwardly and downwardly therewith, and actuable between a first condition in which the elevator and a suspended string are free to rotate relative to said top drive unit about said axis during vertical movement of the string and a second condition in which said connecting means retain said elevator and torque wrench against rotation about said axis with said tubular member and string as they turn to drill a well;

said connecting means including means for automatically turning said pipe handler to essentially a predetermined rotary setting relative to said top drive unit upon actuation of the connecting means to said second condition.

10. Well drilling apparatus as recited in claim 9, in which said connecting means permit limited vertical movement of said pipe handler relative to said top drive unit, said means for turning the pipe handler relative to the top drive unit including means responsive to vertical movement of the pipe handler relative to the top drive unit to turn the pipe handler toward said predetermined rotary setting.

11. Well drilling apparatus as recited in claim 9, in which said connecting means including means supporting said elevator yieldingly for downward movement relative to the top drive unit by the weight of a drill string suspended by the elevator, said means for turning the pipe handler including cam means operable upon upward movement of the elevator relative to the top drive unit to turn the elevator toward said predetermined rotary setting relative to the top drive unit.

12. Well drilling apparatus as recited in claim 9, in which said connecting means include means resiliently supporting said elevator for downward movement relative to the top drive unit, said means for automatically turning the pipe handler including first cam means movable upwardly and downwardly with the elevator, and second cam means engageable by said first cam means upon upward movement of the elevator relative to the top drive unit to turn the pipe handler toward said predetermined rotary setting relative to the top drive unit.

13. Well drilling apparatus as recited in claim 12, in which said second cam means are rotatively adjustable relative to said top drive unit to vary the rotary setting to which said pipe handler is turned by said first and second cam means.

14. Well drilling apparatus comprising:

a top drive unit to be received at the upper end of a drill string and which is movable upwardly and downwardly with the string and includes a tubular member to be connected to the upper end of the string for rotation therewith about the axis of the string and a motor for power rotating said member and the connected string to drill a well;

a pipe handler including a powered torque wrench operable to apply torque in opposite directions to said string and said tubular member and an elevator adapted to suspend said string when it is detached from said member; and connecting means attaching said pipe handler to said top drive unit for movement upwardly and downwardly therewith, and actuable between a first condition in which the elevator and a suspended string are free to rotate relative to said top drive unit about said axis during vertical movement of the string and a second condition in which said connecting means retain said elevator and torque wrench against rotation about said axis with said tubular member and string as they turn to drill a well;

said connecting means including means for automatically actuating said connecting means from said second condition in which the elevator and torque wrench are retained against rotation with said tubular member to said first condition in which the elevator is free for rotation relative to the top drive unit in response to suspension of a drill string by said elevator.

15. Well drilling apparatus as recited in claim 14, in which said means for automatically actuating said connecting means from said second condition to said first condition include means which retain the elevator against rotation relative to the top drive unit in an upper position of the elevator and release the elevator for rotation relative to the top drive unit in a lower position of the elevator.

16. Well drilling apparatus comprising:

a top drive unit to be received at the upper end of a drill string and which is movable upwardly and downwardly with the string and includes a tubular member to be connected to the upper end of the string for rotation therewith about the axis of the string and a motor for power rotating said member and the connected string to drill a well;

a first structure connected to said top drive unit for rotary adjusting movement relative thereto about said axis and adapted to be releasably retained in different rotary settings relative to the top drive unit;

a pipe handler carried by said top drive unit for movement upwardly and downwardly therewith and including a powered torque wrench operable to apply torque in opposite directions to said string and said tubular member and an elevator adapted to suspend said string when it is detached from said member;

said pipe handler in a first condition of the apparatus being free to rotate with a drill string suspended by said elevator and relative to said first structure and said top drive unit about said axis during vertical movement of the string; and means operable in a second condition of the apparatus to retain said elevator and torque wrench against rotation about said axis relative to said first structure and said top drive unit and with said tubular member and string as they turn to drill a well.

17. Well drilling apparatus as recited in claim 16, in which said last mentioned means include cam means operable upon upward movement of said pipe handler relative to said first structure and top drive unit to cam the pipe handler rotatively to a predetermined rotary setting relative to said first structure.

18. Well drilling apparatus comprising:

a top drive unit to be received at the upper end of a drill string and which is movable upwardly and downwardly with the string and includes a non-rotating housing, a tubular member to be connected to the upper end of the string for rotation therewith relative to said housing about the axis of the string, and a motor for power rotating said member and the connected string to drill a well;

a first swivel element attached to said housing and retained thereby against rotation about said axis;

a second swivel element mounted for rotation relative to said first swivel element;

a powered torque wrench suppported by said second swivel element and rotatable therewith and operable to apply torque in opposite directions to said string and said tubular member;

an elevator resiliently supported by said second swivel element for downward movement relative thereto and adapted to suspend said string when it is detached from said tubular member;

said two swivel elements containing fluid passages which are opposite one another and in communication with one another in different relative rotary positions of the two swivel elements in a relation maintaining communication between the passages through an unlimited number of revolutions of the second swivel element and torque wrench and elevator relative to the first swivel element;

fluid conduit means for delivering pressure fluid through said passages to said torque wrench to actuate the torque wrench;

an additional element mounted for rotary adjusting movement about said axis relative to said housing of the top drive unit;

means for releasably retaining said additional element in any of different rotary settings relative to said housing;

first cam means movable upwardly and downwardly with said elevator relative to the top drive unit; and second cam means carried by said additional element and engageable with said first cam means upon upward movement thereof with the elevator to cam the elevator and torque wrench rotatively relative to said additional element and said housing of the top drive unit to a predetermined rotary setting relative to said additional element.

19. Well drilling apparatus as recited in claim 18, in which one of said cam means includes a roller, and the other of said cam means includes a ramp surface extending arcuately about said axis and advancing upwardly and downwardly as it extends circularly and engageable with said roller to turn the elevator and torque wrench to said predetermined rotary setting relative to said additional element.

20. Well drilling apparatus as recited in claim 18, including a part disposed about said tubular member above said torque wrench, links extending downwardly from said part past the torque wrench and suspending said elevator therebeneath, and two torque arrester assemblies having first sections connected to and suspended by said second swivel element and having second sections projecting downwardly through openings in said part and suspending said part and yieldingly supported by and movable upwardly and downwardly relative to said first sections.

21. Well drilling apparatus as recited in claim 20, including a structure connected to said second sections for movement upwardly and downwardly therewith and carrying said first cam means.

22. Well drilling apparatus as recited in claim 20, including a structure connected to said second sections for movement upwardly and downwardly therewith, said first cam means including a post projecting upwardly from said last mentioned structure and carrying a roller, and said second cam means including a ramp element extending essentially circularly about said axis and having a ramp surface which is engaged by said roller and advances upwardly and downwardly as it extends circularly.

* * * * *